US005359743A

United States Patent [19]

Von Harten et al.

[11] Patent Number: 5,359,743

[45] Date of Patent: Nov. 1, 1994

[54] CONTINUOUS PROCESS AND INSTALLATION FOR TREATING TEXTILE FABRIC WEBS

[75] Inventors: Günter Von Harten, Kaarst; Walter Keller, Willich; Johannes Kutz, Tönisvorst; Bernhard Benz, Krefeld; Christian Meyer, Viersen-Dülken; Wolfgang Kurschatke, Krefeld, all of Germany

[73] Assignee: Eduard Küsters Maschinenfabrik GmbH, Krefeld, Germany

[21] Appl. No.: 920,313

[22] PCT Filed: Feb. 8, 1991

[86] PCT No.: PCT/DE91/00101

§ 371 Date: Aug. 12, 1992

§ 102(e) Date: Aug. 12, 1992

[87] PCT Pub. No.: WO91/13200

PCT Pub. Date: Sep. 5, 1991

[30] Foreign Application Priority Data

Feb. 26, 1990 [DE] Germany ..... 4005980

[51] Int. Cl.[5] ..... D06B 3/12

[52] U.S. Cl. ..... 8/151; 68/13 R; 68/22 R; 68/200

[58] Field of Search ..... 68/9, 200, 205 R, 13 R, 68/22 R; 8/151

[56] References Cited

U.S. PATENT DOCUMENTS

| | | | |
|---|---|---|---|
| 1,568,959 | 1/1926 | Chase et al. | 8/151 X |
| 2,071,922 | 2/1937 | Drobile et al. | 8/151 X |
| 2,522,900 | 9/1950 | Schmitt | 68/22 R X |
| 3,811,834 | 5/1974 | Schwemmer et al. | 8/151 |
| 4,213,217 | 7/1980 | Kretschmer et al. | 8/151 |
| 4,620,330 | 11/1986 | von der Eltz et al. | 8/151 |
| 4,672,705 | 6/1987 | Bors et al. | 8/151 |
| 4,829,791 | 5/1989 | Tischbein | 68/22 R |
| 4,845,791 | 7/1989 | Schwemmer et al. | 68/22 R |
| 4,873,846 | 10/1989 | Talbert, Jr. | 68/5 |
| 4,878,365 | 11/1989 | Kutz | 68/9 |

FOREIGN PATENT DOCUMENTS

| | | | |
|---|---|---|---|
| 0361098 | 4/1990 | European Pat. Off. . | |
| 1181404 | 6/1959 | France . | |
| 2216758 | 11/1975 | Germany . | |
| 1710477 | 9/1976 | Germany . | |
| 2544494 | 4/1977 | Germany | 68/22 R |
| 2655955 | 6/1978 | Germany . | |
| 2829319 | 1/1979 | Germany . | |
| 2908345 | 9/1980 | Germany . | |
| 2949423 | 6/1981 | Germany . | |
| 3733997 | 4/1989 | Germany . | |
| 2000819 | 1/1979 | United Kingdom . | |

*Primary Examiner*—Frankie L. Stinson
*Attorney, Agent, or Firm*—Kenyon & Kenyon

[57] ABSTRACT

A device for continuously treating a textile fabric web comprises at least one application devices for applying one or more treatment liquors to the fabric web. After applying the liquors, the fabric web exhibits a total moisture content in the range of 100 to 220% of the weight of the dry fabric. The fabric web with the moisture is fed into a tower-like heating zone of an ager, in which the fabric web is guided over a path consisting of a plurality of horizontal loops.

10 Claims, 2 Drawing Sheets

CONTINUOUS PROCESS AND INSTALLATION FOR TREATING TEXTILE FABRIC WEBS

BACKGROUND OF THE INVENTION

The present invention relates to an improved continuous process and installation for treating textile fabric webs.

A two-step coating method and a corresponding installation are disclosed in German Published Patent Application 37 33 997. An important feature of this two-step liquor application is the possibility of applying more liquid to the web, that is, achieving moisture contents (i.e., liquid weight in proportion to the weight of the dry fabric) which lie far above those that are attainable using devices that work with squeezing devices, which exhibit an applied pressure that produces a uniform line pressure and prevents the fabric web from slipping through. In the second coating device, the additional liquid is only applied, but is not exchanged for the liquid quantity applied by the first coating device. The second coating is, therefore, purely an additional impregnation. The question of how such a heavily loaded fabric web should be directed in the ager to prevent the liquid from running off or dripping off is not addressed by this patent application.

The present invention is directed to the problem of developing a process, and a corresponding installation, which will ensure that a fabric web which is heavily loaded with treatment liquor will undergo the proper treatment sequence in an ager.

SUMMARY OF THE INVENTION

The present invention provides a continuous process for treating textile fabric webs in which the web is guided in the heating zone of an ager in a zig-zag path formed by several essentially horizontal loops that are located one over the other.

Guiding the web in essentially horizontal loops in the heating zone of the ager prevents the liquid from running down the web and also prevents any related unevenness in the liquid coating of the fabric web which would occur at the vertical sections of the conventional guidance path of a fabric web in an ager. The amply applied treatment liquor can penetrate into the web while in the dwelling section, which is made up of a number of essentially horizontal loops. An important element of the present invention is that the liquid carried along when the fabric web runs towards a guide roller on the side of the fabric web facing this guide roller is drawn into the nip between the fabric web and this guide roller and is pressed into the fabric web. This promotes the mixing, for instance, of several existing treatment liquors, the penetration of the treatment liquors into the fabric web, and the interaction of the treatment liquors in the depth of the fabric web. Therefore, the heating zone not only has a temperature-increasing function, but also a force-through and a reaction function. By the end of the heating zone, which is composed of horizontal loops, the last applied treatment liquor has been forced into the web, and the danger of the liquid coating running dripping off, causing local unevenness, is thereby reduced. Therefore, in principle, the subsequent guiding of the web in the ager can occur in the usual way, although special methods for guiding the web are preferred for certain treatments.

Guiding a fabric web in horizontal loops is known in and of itself from the German Printed Patent 17 10 477.

However, this reference concerns an open-width processing operation and not the formation of a heating zone in an ager. Such a guidance method, also in an ager, is to be inferred from DE-A 29 08 345, however the horizontal guidance does not occur in a feeding zone and is not used in connection with a liquid application. The same is true of U.S. Pat. No. 4,873,846, in which virtually the entire guidance section exists in the ager in horizontal loops.

In the case of FR-A 1,181,404, the fabric web runs in upright loops through a tank with a large supply of bleaching liquor. After passing a vertical heating zone, the fabric web is folded in a J-box, where it dwells for a period; neither a horizontal guidance system nor a steam atmosphere is present. The feature of feeding the fabric web after a liquid application into an ager and of guiding it horizontally is likewise to be inferred in and of itself from the German Printed Patent 22 16 758. In this case, however, there is only a single-step, one-sided application of a patterning means, and the web is merely guided along one horizontal section, not in many superposed, essentially horizontal loops.

An important aspect of the present invention relates to the second liquor application and the subsequent wiping of the web, which has special significance in combination with the specially designed heating zone of the downstream ager. The manner in which the fabric web is subsequently directed in the heating zone of the ager is adapted to this application of the second treatment liquor. The fabric web is first soaked with a first treatment liquor and squeezed out, whereupon an application of an additional treatment liquor from both sides follows. This second treatment liquor, therefore, coats the outside of the web and, together with the treatment liquor already existing in this web, results in a very high total moisture content. Provisions are made in the ager so that the treatment liquors mix together and are active while at the same time, they are not able to run or drip down on to the fabric web.

The earlier mentioned nip formation and the subsequent pressing of the treatment liquor into the fabric web is produced by the guide roller arrangement of the present invention. This arrangement also prevents the treatment liquor from running back along the fabric web in the heating zone.

There are treatments, such as bleach treatments for example, which require a longer period of dwelling in the ager than are attainable with loop agers. The present invention provides a refinement of the ager to accomplish this task.

The present invention is also adapted to neatly place the fabric web in uniform folds. The entire length of the fabric web is essentially horizontally staggered on the conveyance device, and each fold lies under the weight of a few upper layers at most. This reduces the danger of permanent crease markings, which are often a problem in bleach treatments.

To render it possible for the steam to attack the fabric web again after the web has left the heating section, the web is guided in essentially vertical loops in the ager.

An important, practical application of the present invention is to a bleaching process. The high total liquor application of 100 to 220%, which is possible because of the device used for the second liquor application of the present invention and which is able to be practically handled because of the ager of the present invention, permits a single-stage NaOH/peroxide bleaching to be implemented in which NaOH and peroxide are applied in a treatment liquor having the appropriate high water mobility. As a result, in many cases one can dispense with a scouring stage before the bleaching operation. This is achieved by combining a prewashing step in a liquor vat with controlled squeezing, applying a multi-component bleaching liquor and a subsequent extraction to a uniform, very high final moisture, and by using the ager of the present invention with heating zones containing horizontal loops.

The guide rollers of one group are advantageously arranged, vertically, one over another. This configuration renders possible the formation of a slight incline of the web in the upstream direction and, moreover, results in a low overall height, permitting many guide rollers to be accommodated in the ager given the available height.

The guide-roller configuration of the present invention forms a narrow, high tower in the leading area of the ager with which a small amount of overall required space, preferably about 1 meter, contains quite a considerable horizontal dwelling section with many turns.

DETAILED DESCRIPTION

The present invention is depicted as a bleaching installation, however, the present invention may be used in any liquor treatment of textile webs.

After it is manufactured, the fabric web 10, consisting completely or mostly of cotton fabric, still contains the impurities introduced with the cotton, such as seed trash, wax, grease, and, moreover, the sizing agent. These substances, which were introduced in an uncontrollable fashion, catalyze the decomposition of the peroxide during a peroxide-bleaching process, so that the bleaching process becomes destabilized. It is, therefore, necessary to remove these substances as thoroughly as possible before the actual bleaching process.

Figure 1:
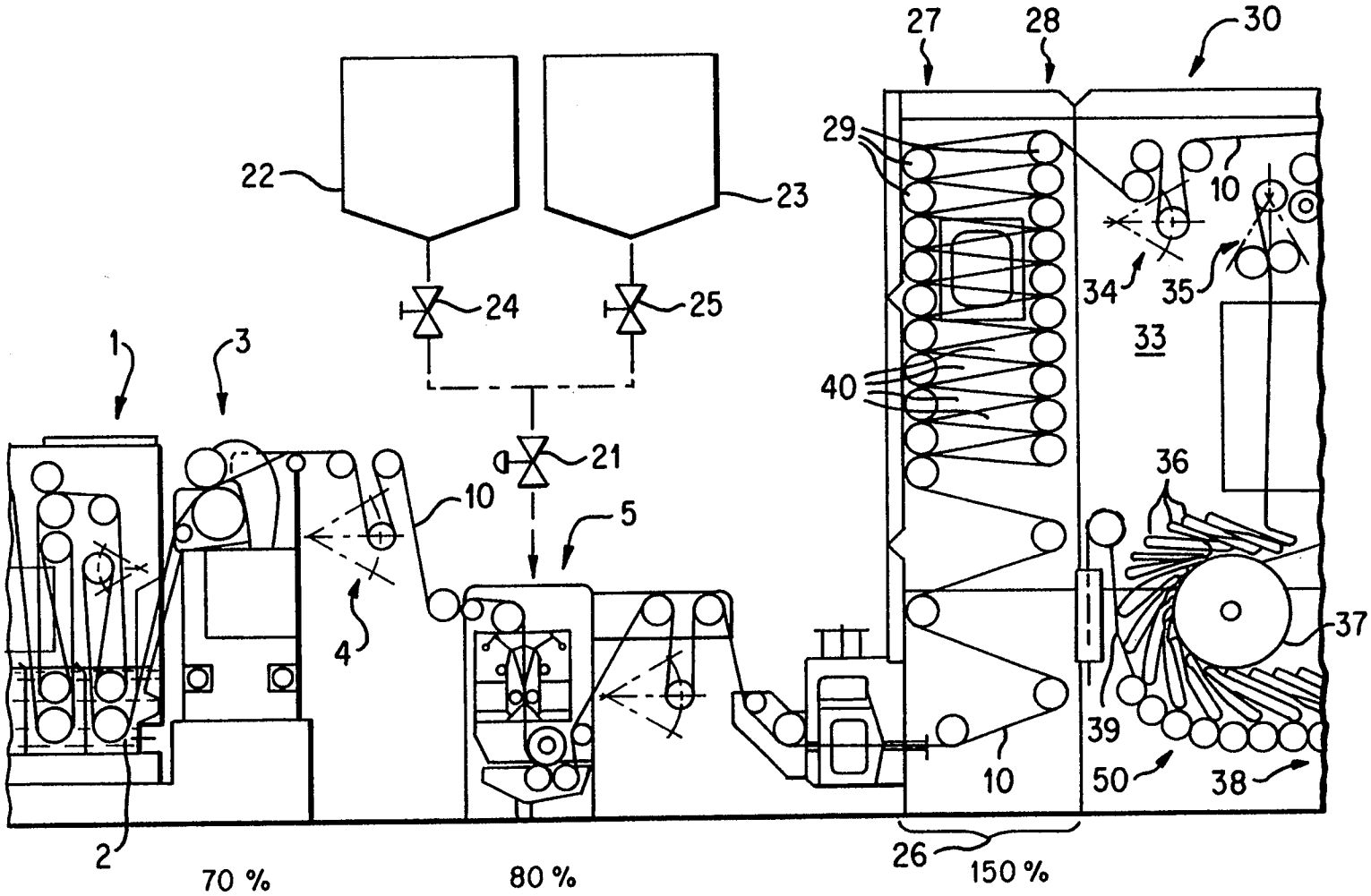
FIG. 1 shows a side view of the installation for the continuous treatment of a fabric web constructed according to the principles of the present invention.

For this reason, after the fabric web 10 is unwound from the roller (not shown), it runs through an intensive washing process at high temperatures in several liquor vats, of which the final area of the last liquor vat 1 is shown on the left side of FIG. 1. The liquor vat 1 forms a first application device in which a first treatment liquor is applied to the fabric web 10 in the form of the washing liquor 2.

Figure 2:
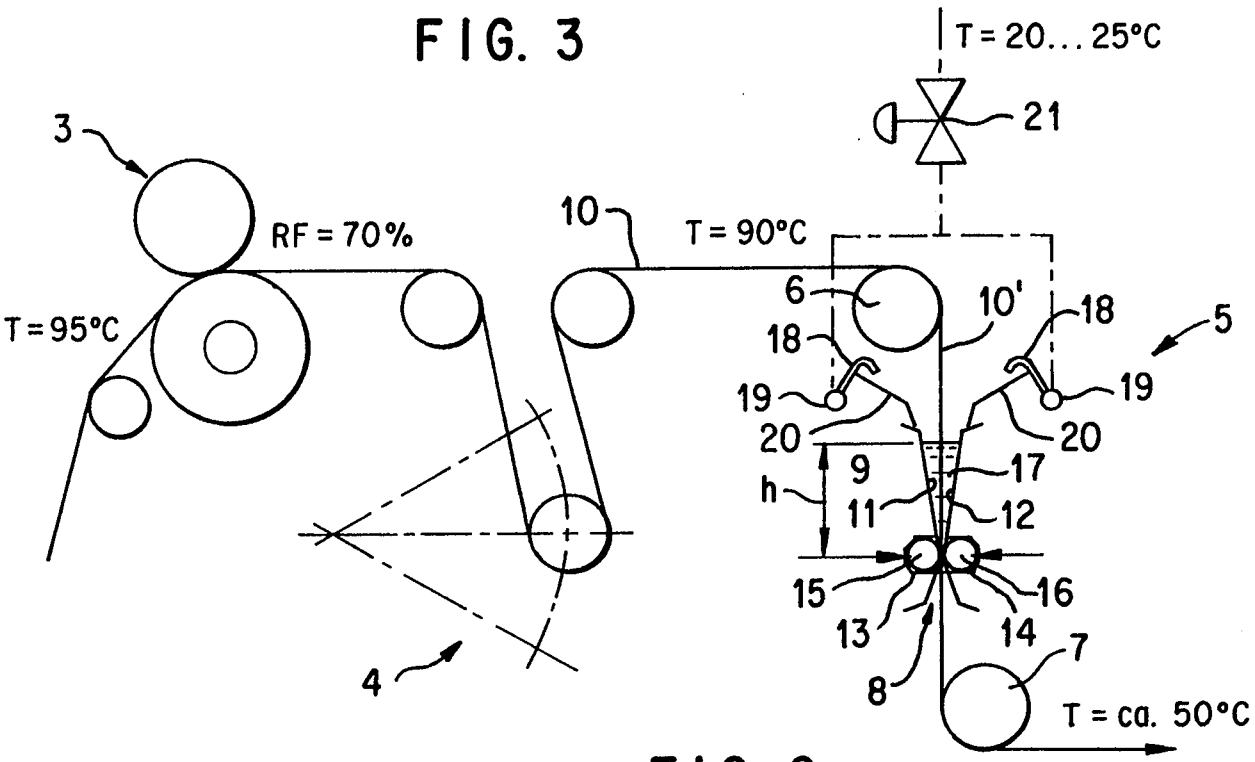
FIG. 2 shows an enlarged view of the application device of the present invention.

After leaving the liquor vat 1, the fabric web 10 is fed to a squeezing apparatus 3 and uniformly squeezed out over its width to a residual moisture content of about 70%. In the area of the squeezing apparatus 3, the temperature of the fabric web 10 is still about 95° C., as indicated in FIG. 2.

After leaving the squeezing apparatus 3 and passing through a dancing-roller or pendulum-type-roller configuration 4, which serves to control the preferential speed of the fabric web, the fabric web 10 arrives in a second application device 5 (FIG. 2), where it is guided in a section 10', over guide rollers 6,7, arranged one over another, vertically from top to bottom. In section 10', the fabric web 10 runs through a gap 8 formed at the bottom end of an upright, narrow trough 9, which extends across the width of the web and is more or less V-shaped in its vertical cross-section. The inner walls 11, 12, which converge toward the bottom, have chambers 13,14 at their lower end which extend horizontally across the width of the web. Arranged in these chambers are inflatable tubes 15,16, which abut against the fabric web 10 on both sides and seal off the gap 8 at the bottom, so that the second treatment liquor 17, which rises up in the trough 9 to a relatively low filling level h of 20 to 25 cm, cannot flow through the gap 8.

The fabric web 10 passes through the treatment liquor 17 from top to bottom and is wiped off on both sides by the tubes 15,16. Thus, in addition to the residual moisture of the first treatment liquor 2 that remains in the web, the web takes along with it a relatively large quantity of the treatment liquor 17, which is applied uniformly to both sides.

The treatment liquor 17 is fed into the trough 9 through a plurality of elbow tubes 18, which are distributed over the width of the fabric web 10 and are fed by supply pipes 19. These supply pipes 19 collectively extend across the width of the web and discharge liquid through the elbow tubes 18 on to drain plates 20 from whose lower edge the liquid runs off into the trough 9. The supply pipes 19 are fed via a controllable valve 21 from supply tanks 22,23 arranged above the application device 5. In the illustrated embodiment in which a bleaching liquor is applied, these supply tanks 22,23 can contain, for example, a sodium hydroxide solution and a peroxide solution. The proportions are adjusted by the valves 24,25.

The trough 9 contains only a relatively small quantity of liquid amounting to a few liters, which suffices for only a few meters of web length and hence is constantly replenished in accordance with the level of consumption. The components of the treatment liquor 17 the supply tanks 22,23 are, therefore, only brought together immediately before the application to the fabric web 10. Also, the liquor 17 cannot be depleted of its components in the trough 9, because the entire liquor bath is always replaced within a few seconds. These are advantageous features when compared to a liquor vat, in which the liquor is depleted as the result of the constant removal of components and which can only be counteracted with a great deal of extra work, particularly in the case of bleaching liquors in which a partial decomposition of the peroxide cannot be ruled out due to the long time period the various chemicals are in contact.

Figure 3:
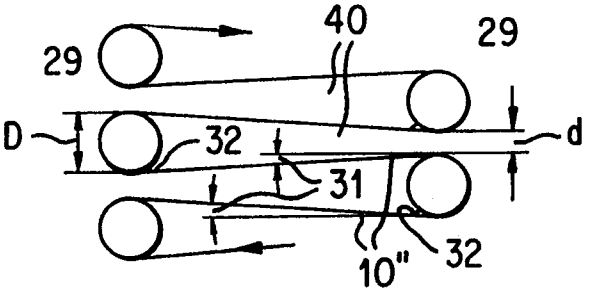
FIG. 3 shows some of the horizontal loops in the heating zone of the ager on an enlarged scale.

After leaving the application device 5, the fabric web is thoroughly loaded with the residual moisture of the treatment liquor 2 and, moreover, with the additionally applied quantity of the treatment liquor 17 on both sides. With an additional application of about 80%, one obtains a total moisture content of about 150%, which is the limit of the moisture absorption capability of the fabric. This large quantity of moisture provides an ideal liquid supply for carrying out the bleaching operation. However, it requires a special treatment in the downstream ager 30, which contains a tower-like heating zone 26, into which the fabric web 10 runs from below. The heating zone 26 comprises two groups 27,28 of horizontal guide rollers 29, which are all the same and arranged parallel to each other, and vertically over one another. The fabric web 10 is guided over the guide rollers 29 in a zig-zag path from the bottom to the top, in essentially horizontal loops 40. As shown in FIG. 3, the vertical distance d between two guide rollers 29, arranged vertically one over the other, is smaller than the diameter D of an individual guide roller 29. Moreover, the axes of each of the guide rollers 29 in one group, for example group 28, are arranged at a height midway between the axes of adjacent guide rollers 29 of each of the other groups, for example group 27. As a result, the method of guiding the fabric web depicted in FIG. 3 exhibits a slight inclination of the straight fabric web sections 10'' located between the guide rollers 29. This incline is indicated in FIG. 3 by the angle 31, which in the embodiment illustrated is equal to 7°, and may equal about 5° to 10°.

Small beads 32 of treatment liquor form in front of the guide rollers 29, as defined by the direction in which the fabric web sections 10'' run. These beads are pressed into the fabric web 10 when it revolves around the guide roller 29. As a result, the treatment liquor 17, applied externally in the application device 5, penetrates through the entire fabric web. As a result of the quite predominantly, essentially horizontal guidance of the fabric web in the heating zone 26, the relatively large quantity of liquor is prevented from running down on to the sections of the fabric web below. Accordingly, evidence of dripping liquor, which could lead to an unevenness in the final appearance after treatment, is avoided.

After leaving the heating zone 26, the fabric web 10 enters into the actual ager 33. The fabric web 10 is guided, as desired, over a dwelling section (not shown) having vertical loops by way of a compensator 34, which has a dancing roller and serves to control the preferential speed. Next, or right after leaving the heating zone 26, the web 10 is transported essentially horizontally, in folds, to a conveyance device 50 across a dwelling section. This step is accomplished by a cuttling machine 35, which lays down the fabric web 10 in uniform folds 36 on the top side of a revolving drum 37. The revolving drum 37 collects the folded stack, turns it over in an orderly fashion, and puts it down on a horizontal conveyer 38, which extends tangentially from the bottom side of the drum 37. The fabric web 10 covers the dwelling section in folded layers on this horizontal conveyer 38. A flexibly tensioned band 39 on the side of the drum 37 prevents the folded stack from falling down. The folded stack is pulled apart at the end (not shown) of the horizontal conveyer 38. This step is followed by a washing procedure.

We claim:

1. A continuous method for treating a textile fabric web, comprising the steps of:

applying at least a first treatment liquor in at least one step;

squeezing out said first treatment liquor such that the web has a moisture content of 60 to 120% to form a damp fabric web;

applying a second treatment liquor to both sides of the damp fabric web, such that the web contacts only small liquor supply, said supply being continuously consumed and replenished at a substantially equal rate feeding the web with said treatment liquor into a heating zone of an ager; and guiding the web in said heating zone along a zig-zag path formed by a plurality of essentially horizontal loops that are inclined downward in an upstream direction, said horizontal loops being located one over the other, wherein the web attains a moisture content of 100–220% in the course of the treatment.

2. The continuous method of claim 1, further comprising the step of transporting the fabric web to the ager located downstream from the heating zone in the form of folds in a dwelling zone.

3. The continuous method of claim 2, further comprising the step of guiding the fabric in vertical loops after it traverses said heating zone and said dwelling zone.

4. The continuous method of claim 1 wherein said treatment is a bleaching treatment.

5. An installation for continuously treating a textile fabric web, said installation comprising:

a first application device that includes a first device for impregnating the fabric web and a roller squeezing apparatus located downstream from said first impregnating device;

a second application device, located downstream from and proximate to said first application device, which includes a second device for impregnating the fabric web by contacting both sides of the web with a very small liquor supply that is replenished at a rate substantially equal to the rate of consumption;

a wiping device, located immediately downstream from said second application device, which includes at least one inflatable tube forming a gap extending across the width of the web through which the web passes, said tub being inflatable to sealingly abut against the fabric web;

a tower-like heating zone, located downstream from said wiping device, which includes two groups of guide rollers arranged in columns, the vertical distance between adjacent guide rollers of one group being smaller than the diameter of said guide rollers of said other group and the axis of each one of said guide rollers of one group being located at a height midway between the axes of the nearest two of said guide rollers of said other group, whereby the fabric web can be guided between said guide rollers in a zig-zag path to form essentially horizontal loops having essentially horizontal sections that are slightly inclined in the upstream direction; and an ager, located downstream from said heating zone.

6. The installation of claim 5, wherein said toner-like heating zone has a length in the horizontal direction of approximately 1 meter.

7. The installation of claim 6, wherein said ager comprises a conveyance device located downstream from said heating zone for transporting the fabric web in a controlled, folded layer across a dwelling section.

8. The installation of claim 7, wherein said conveyance device comprises:

a cutting device for folding the web into folded multilayers having folds substantially perpendicular to the direction of travel of the web;

a rotating drum having an axis of rotation perpendicular to the folds in the web for collecting and inverting the folded web; and a horizontal conveyor for transporting the folded web, said horizontal conveyor being located below said drum and extending tangentially therefrom.

9. The installation of claim 8, wherein said dwelling section is located between said heating zone and said conveyance device, and further comprises a device for guiding the fabric web in said dwelling section in vertical loops.

10. The installation of claim 7, wherein said dwelling section is located between said heating zone and said conveyance device, and further comprises a device for guiding the fabric web in said dwelling section in vertical loops.

* * * * *